US006296339B1

(12) United States Patent
Geserich et al.

(10) Patent No.: US 6,296,339 B1
(45) **Date of Patent: *Oct. 2, 2001**

(54) DEVICE FOR PRINTING TO STOCK IN NON-VERTICAL ORIENTATION

(75) Inventors: Frank Geserich; Wolfgang Von Inten, both of Berlin (DE)

(73) Assignee: Francotyp-Postalia AG & Co., Birkenwerder (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/315,327

(22) Filed: May 20, 1999

Related U.S. Application Data

(62) Division of application No. 08/791,629, filed on Jan. 31, 1997.

(30) Foreign Application Priority Data

Jan. 31, 1996 (DE) ..... 196 05 015
Oct. 25, 1996 (DE) ..... 196 45 363

(51) Int. Cl.[7] ..... B41J 4/01
(52) U.S. Cl. ..... 347/4
(58) Field of Search ..... 347/4, 2; 198/836.1, 198/836.2; 101/40; 271/264

(56) References Cited

U.S. PATENT DOCUMENTS 5,025,386 6/1991 Pusic ..... 364/478
5,467,709 11/1995 Salomon ..... 101/93
5,880,747 * 3/1999 Bartenwerfer et al. ..... 347/4

FOREIGN PATENT DOCUMENTS 2 272 401 A 5/1994 (GB) .

OTHER PUBLICATIONS

International Publication No. WO 90/01742 (Pusic), dated Feb. 22, 1990.

International Publication No. WO 90/04824 (Pusic), dated May 3, 1990.

* cited by examiner

*Primary Examiner*—John Barlow
*Assistant Examiner*—Julian D. Huffman
(74) *Attorney, Agent, or Firm*—Herbert L. Lerner; Laurence A. Greenberg; Werner H. Stemer

(57) ABSTRACT

A device for printing stock such as pieces of mail in postage meters and/or addressing machines. A guide plate, along which the stock slides, is inclined relative to the vertical and has a recessed region for an ink jet printing device with at least one print head. A conveyor advances the stock along the guide plate. The recessed region includes at least one cutout and a downstream region of the guide plate is so far recessed from a bearing surface for the stock that there is no contact with the latter in that location. That ensures sufficient penetration time for ink and prevents smearing of the printed image. The device improves the printing technology and simplifies transport of the piece of mail. The simple construction ensures precise feeding of the stock and a clean printed image.

20 Claims, 14 Drawing Sheets

DEVICE FOR PRINTING TO STOCK IN NON-VERTICAL ORIENTATION

CROSS-REFERENCE TO RELATED APPLICATION

This application is a division of copending application No. 08/791,629, filed Jan. 31, 1997.

BACKGROUND OF THE INVENTION

FIELD OF THE INVENTION

The invention relates to a device for printing to stock, in particular a piece of mail in postage meters and/or addressing machines.

With such devices, the stock is guided past a printing device and the postage indicia or address is printed in a single pass.

The stock is typically guided past the printing device while lying flat as is seen in U.S. Pat. No. 5,467,709, for example, or on edge as is seen in U.S. Pat. No. 5,025,386, for example.

In each case, it is important to ensure that the stock and the printing device are brought into a defined position relative to one another so that the mark is printed in the intended location and with sufficient quality.

In the case of horizontal transport of the stock, a relatively large bearing surface, corresponding to the largest stock format to be printed, is required, thus the machine has a correspondingly large footprint.

In the device disclosed in U.S. Pat. No. 5,467,709, an ink jet print head provides contactless printing. The piece of mail is fed between a driven conveyor and spring-mounted pressure rollers, whereby the piece of mail rests against a longitudinal guide plate. The longitudinal guide plate has a cutout matching the conveyor and a rectangular cutout for the ink jet print head. A row of nozzles in the print head run along the diagonal of the cutout. The conveyor, the longitudinal guide plate and the ink jet print head are located above the piece of mail. Spring-mounted pressure rollers and a spring-mounted pressure roller located in the print area are located below the piece of mail.

The spring travel of the pressure rollers and the pressure plate corresponds to the maximum thickness of the piece of mail, which can vary between 2 mm and 20 mm.

The spring force must be appropriate for the entire range of weights of pieces of mail, approximately 20 to 1000 g, and must also ensure that the piece of mail is held sufficiently planar in the area of the cutout for the print head.

Contactless ink jet printing requires that the smallest possible distance be maintained between the stock and the ink jet print head. That both minimizes the effects of inaccurate ink spray and prevents the stock from contacting the nozzle surface, thus preventing smearing.

However, there is still a risk of smearing when the piece of mail leaves the area of the cutout and inevitably glides along the longitudinal guide plate.

These conditions are difficult to maintain when rapidly processing pieces of mail of varying dimensions. In other words, the rapid processing does not allow the ink to dry prior to further transport following the imprint.

The prior art also discloses a postage meter, as is seen in U.S. Pat. No. 5,025,386, in which the piece of mail is carried on edge and slightly inclined on a rotating conveyor. The pieces of mail rest against a guide block which has a print window. A thermal print head with which the postage indicia is printed on the piece of mail can be moved laterally and vertically within the print window.

The size of the print window must be adapted to the maximum length and width of the printed image.

The individual piece of mail is transported to the print window, then stopped and pressed through the use of a pressure plate against the guide plate or the print window. The pressure plate is driven by a motor through a toothed gearing and crankshaft. It is a relatively complex mechanism and significant counterpressure must also be provided for thermal printing.

After printing, the piece of mail is released and transported away. It is clear that only a low throughput is possible with such an intermittent mode of operation. Positioning of the thermal print head is complex.

SUMMARY OF THE INVENTION

It is accordingly an object of the invention to provide a device for printing stock in non-vertical orientation, which overcomes the hereinafore-mentioned disadvantages of the heretofore-known devices of this general type and which provides simplified transport of a piece of mail and improved printing technology. It is furthermore an object of the present invention to create a device for transporting stock which ensures precise feeding of the stock and a clean printed image through the use of a simple construction.

With the foregoing and other objects in view there is provided, in accordance with the invention, a device for printing to non-vertical stock, in particular a piece of mail in a postage meter or addressing machine, comprising:

a non-vertically aligned guide plate having one side along which stock slides in non-vertical orientation in a transport direction during transport and printing, a downstream end, a recessed region having at least one cutout, and a region following the at least one cutout toward the downstream end at which the stock is substantially free of contact with the guide plate;

an advancing device for advancing the stock along the guide plate in the transport direction; and an ink jet print head of an ink jet printing device for printing to the stock disposed in the recessed region, the ink jet print head having a nozzle plane oriented substantially parallel to the guide plate.

Since printing is contactless, the required pressures are low and friction on the guide plate can be minimized through the use of a correspondingly smooth surface and sliding rails.

In accordance with another feature of the invention, the configuration of the region of the guide plate downstream of the print area or the cutout ensures that the stock is not supported at this location. This ensures a sufficiently long penetration time for the ink, preventing smearing of the printed image.

In accordance with a further feature of the invention, the fact that the nozzle plane is recessed relative to the region upstream of the cutout and that the downstream region is even farther recessed or open prevents the stock from catching on one of the edges.

Specifically, the region of the guide plate downstream of the cutout is either itself cut away or recessed relative to the bearing surface for the stock by an amount which is greater than the greatest expected convexity of the stock in the printed area. This clearance is achieved either by mechanical shaping, such as through the use of the mold in the case of plastic injection molding, or through the use of some metal removing process.

In the latter two variants, this amounts to only a few tenths of a millimeter, but can be as much as two millimeters to achieve the desired graduated recess.

In accordance with an added feature of the invention, the installation of sliding rails running in the direction of transport on the guide plate greatly reduces the bearing surface for the pieces of mail and thus the friction. The aforementioned unsupported area for the printed area of the stock is easily realized in that the sliding rails are farther apart than the printed image is wide and thicker than the greatest expected convexity of the stock.

In accordance with an additional feature of the invention, there is provided an insert of stainless steel as the structured portion of the guide plate, which provides several advantages. This insert can be stamped or cut to size from a piece of sheet metal. Stainless steel can be highly polished, it resists abrasion and it has good sliding properties. The metal effectively dissipates static electricity.

In accordance with yet another feature of the invention, if the postage indicia and address are to be printed in a single pass, an ink jet print head can still be used but an appropriate positioning mechanism for the print head is then required.

If there is a separate ink jet print head for each cutout or print function, not only is there no need for a positioning mechanism, but different colored inks can also be used, such as red for the postage indicia and black for the address.

In accordance with again a further feature of the invention, mounting the incremental transducer and the drive roller on a common axis and the use of a synchronous belt as the conveyor ensures precise monitoring of the conveying distance and no-slip transmission of motion.

Other features which are considered as characteristic for the invention are set forth in the appended claims.

Although the invention is illustrated and described herein as embodied in a device for printing to stock in non-vertical orientation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 2*a,* 2*b* and 2*c* show a guide plate with an insert, in which FIG. 2*a* is a perspective view of a complete device.

DESCRIPTION OF THE PREFERRED EMBODIMENTS

Figure 1:
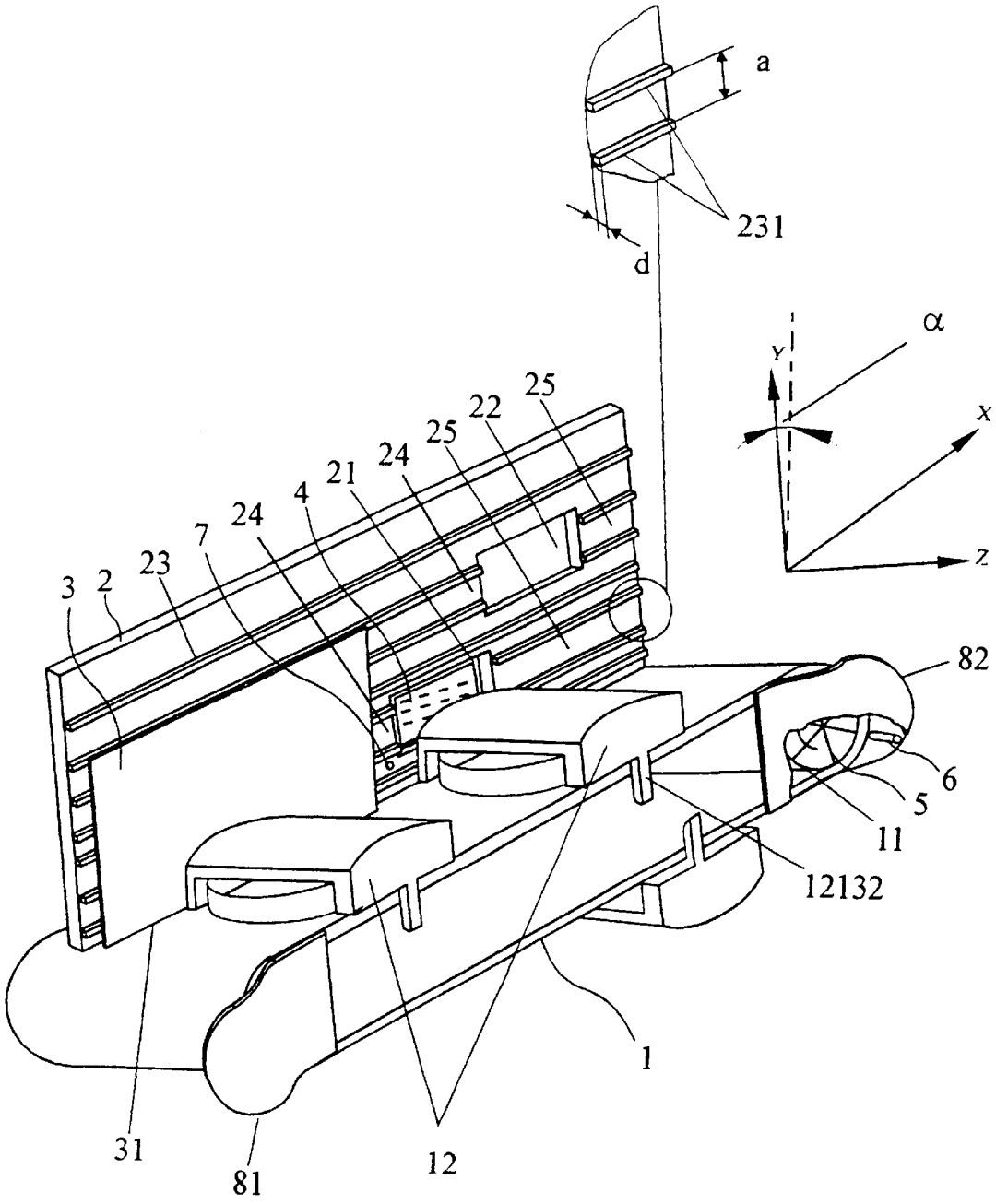
FIG. 1 is a diagrammatic, perspective view of a device according to the present invention which has a planar guide plate and with which a piece of mail is transported on a conveyor with pressure elements.
Figure 9:
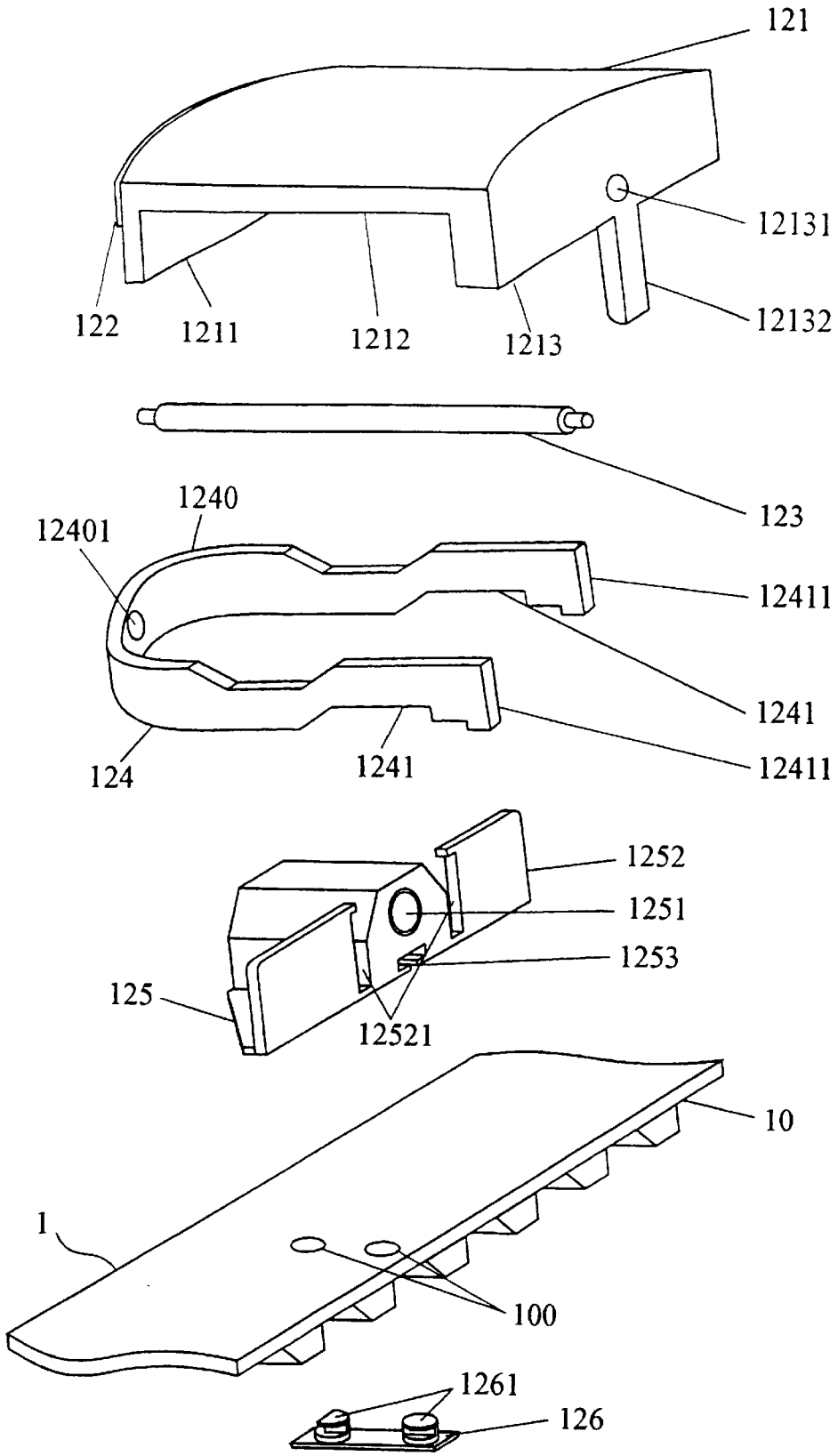
FIG. 9 is an exploded, top and rear perspective view of a pressure element with a spring-mounted pressure plate.
Figure 10:
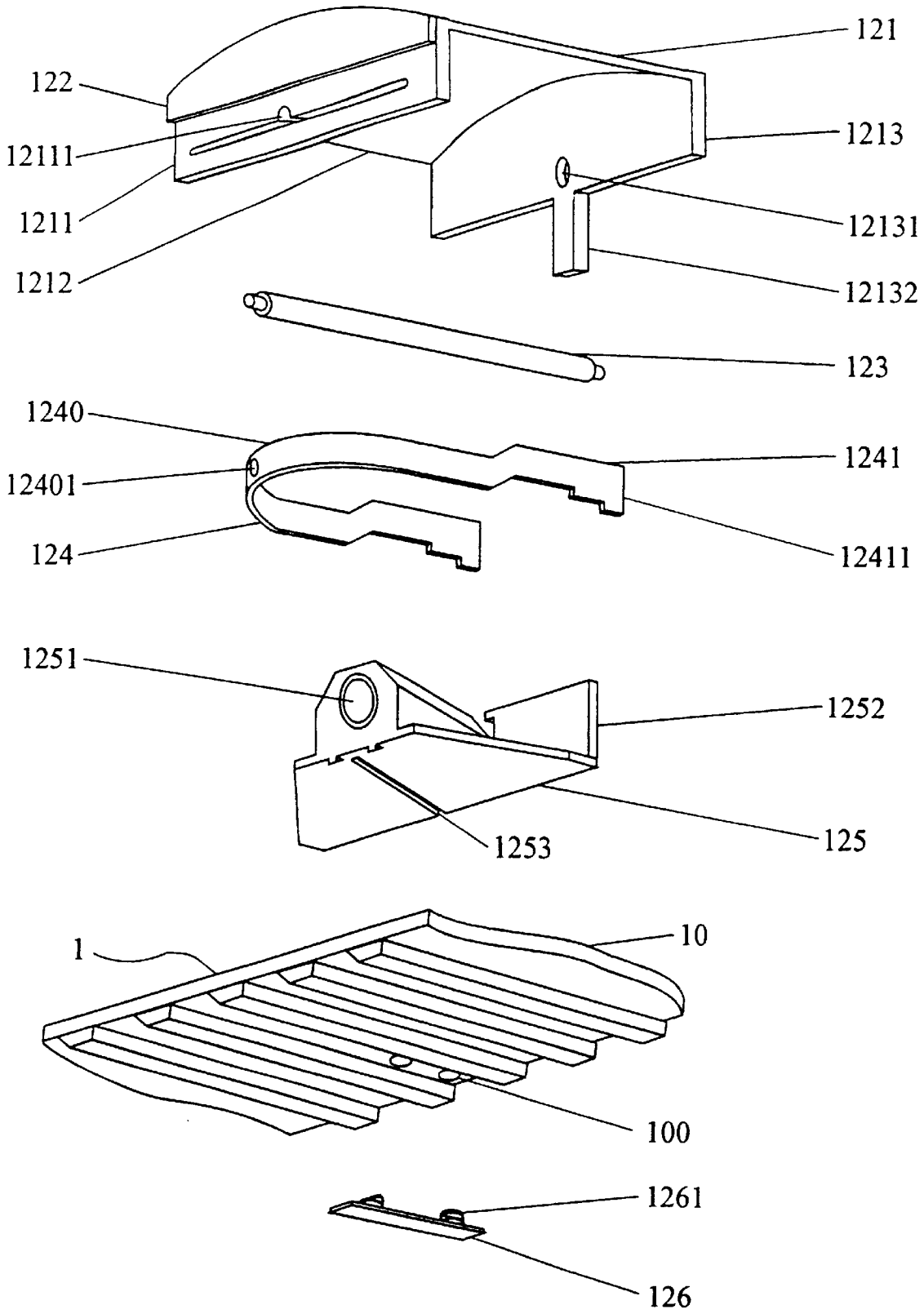
FIG. 10 is an exploded, bottom and front perspective view of a pressure element with a spring-mounted pressure plate.

Referring now in detail to the figures of the drawings, in which not all parts are shown and which are partly diagrammatic for reasons of simplicity and better comprehension, and first, particularly, to FIG. 1 thereof, there are seen pressure elements 12 which are separably fastened to a rotating conveyor 1. To this end, the conveyor 1 has holes 100 formed therein through which a mating plate 126 with crowned pins 1261 protrudes. The pins 1261 are inserted into corresponding non-illustrated openings in the pressure elements 12 as is seen in FIGS. 9 and 10.

The conveyor 1 preferably includes a synchronous belt 10 and two toothed rollers 11. The teeth are not shown for reasons of simplicity. It is appropriate that the mating plate 126 be located in a tooth space and therefore the toothed rollers 11 are correspondingly modified or include cutouts as is seen in FIG. 9.

The powered toothed roller 11, together with an incremental transducer 5, is mounted so as to be stationary on an axle in the vicinity of a print area. The incremental transducer 5 can be realized as a slotted disk illuminated by a photocell 6. A photodiode which is mounted behind the slotted disk for evaluation purposes, is not shown. The incremental transducer 5 interacts through an evaluation and control circuit with a sensor 7 for detection of a front edge of a piece of mail to initiate printing at the proper time.

Figure 4:
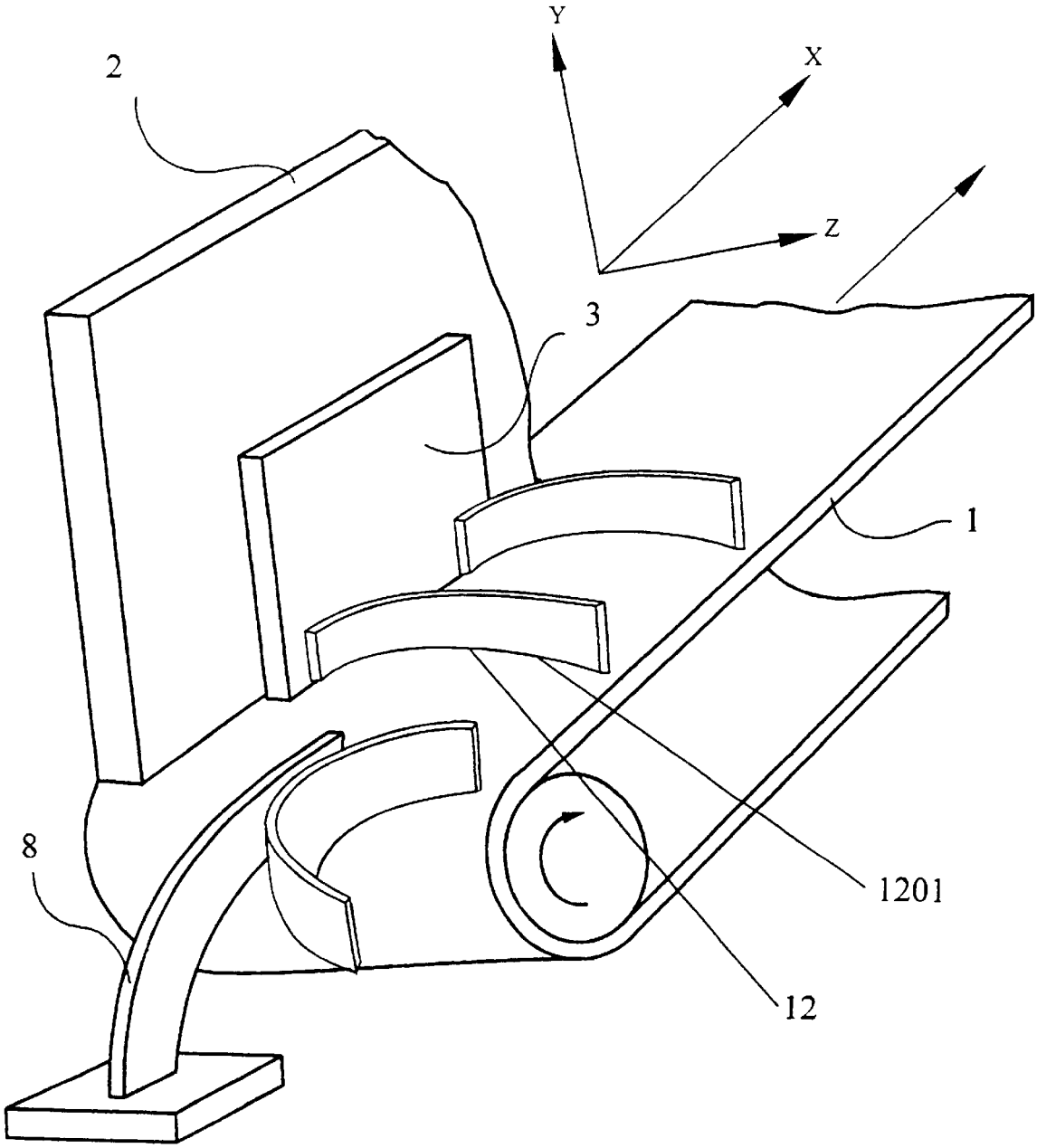
FIG. 4 is a fragmentary, perspective view of a conveyor with strip-shaped clamping elements, mounted on edge.
Figure 5:
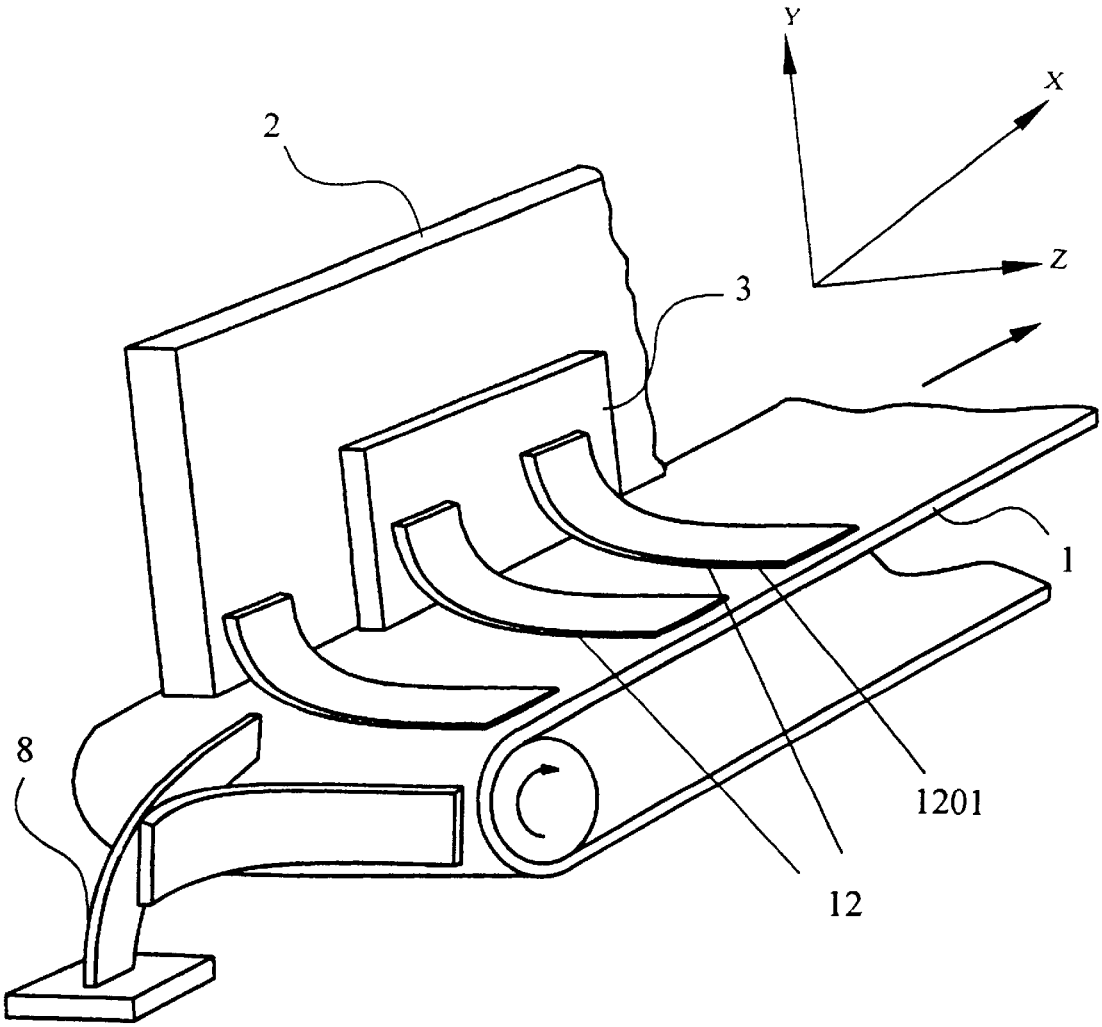
FIG. 5 is a view similar to FIG. 4 of a conveyor with strip-shaped clamping elements, mounted flat.
Figure 6:
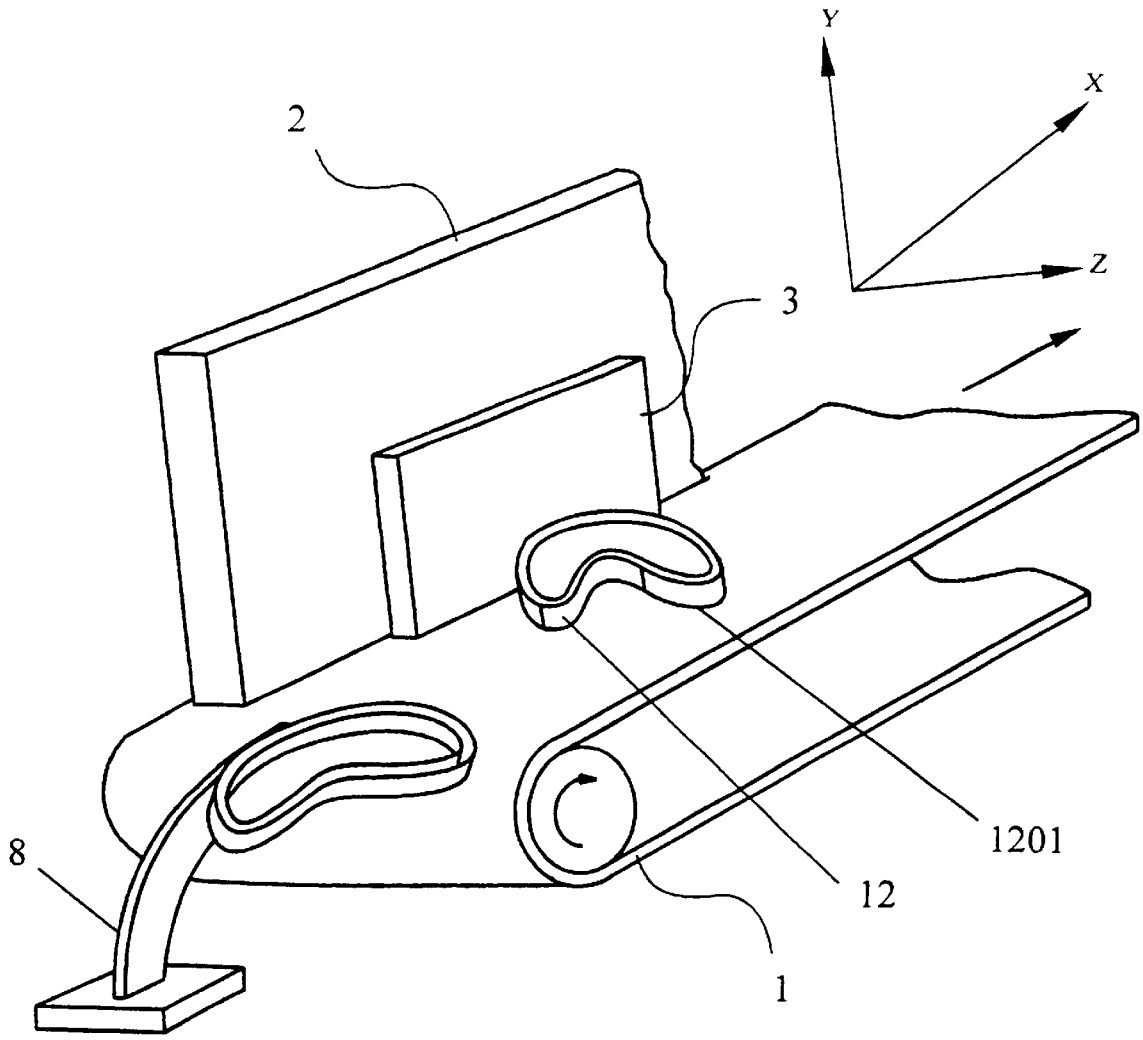
FIG. 6 is another view similar to FIG. 4 of a conveyor with ring-shaped clamping elements, mounted on edge.

Deflecting elements 8 which are seen in FIGS. 4, 5 and 6 are located outside the conveyor 1 but inside the path of the pressure elements 12 where stock such as a piece of mail 3 enters and exits the machine. In this case, these elements 8 are in the form of a connecting link which curves gradually outward. However, they can also be realized as outwardly-bent strips, as is seen in FIGS. 4 through 6. The conveyor 1 may be defined as means for applying an advancing force to the stock 3.

The deflecting elements 8 serve to bend the pressure elements 12 so far backward at the location where the piece of mail 3 enters the machine, that the thickest permissible piece of mail 3 can easily pass onto the conveyor 1.

The deflecting elements 8 serve to bend the pressure elements 12 so far backward at the location where the piece of mail 3 exits the machine, that each conveyed piece of mail 3 is released and can leave the conveyor 1 in the direction of a stacker.

In the illustrated embodiment of the invention, the pieces of mail 3 stand on edge during transport on the conveyor 1.

Figure 3:
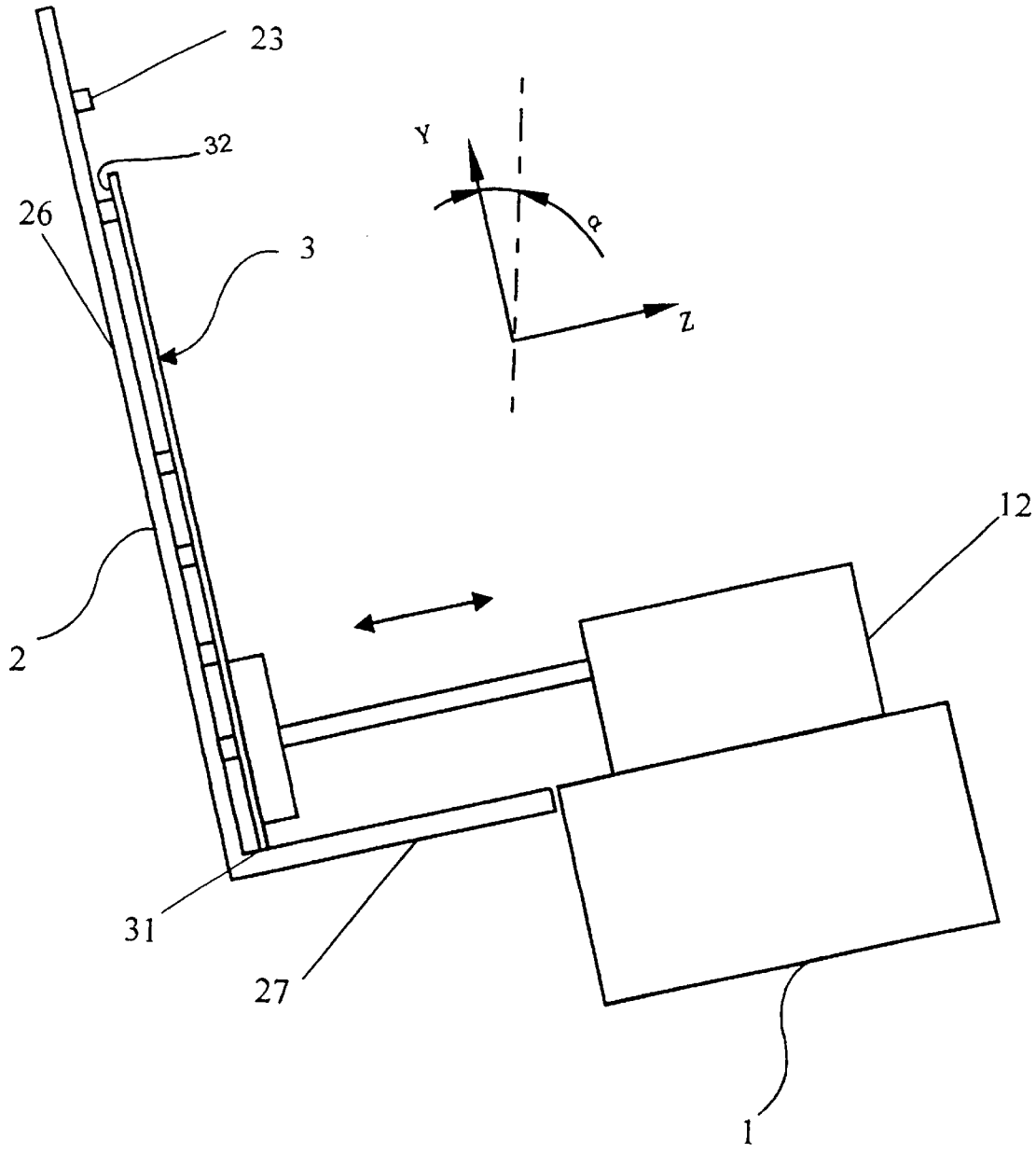
FIG. 3 is a side-elevational view of a device according to the invention which has an L-shaped guide plate and with which the piece of mail is transported on a short leg of the guide plate.
Figure 11:
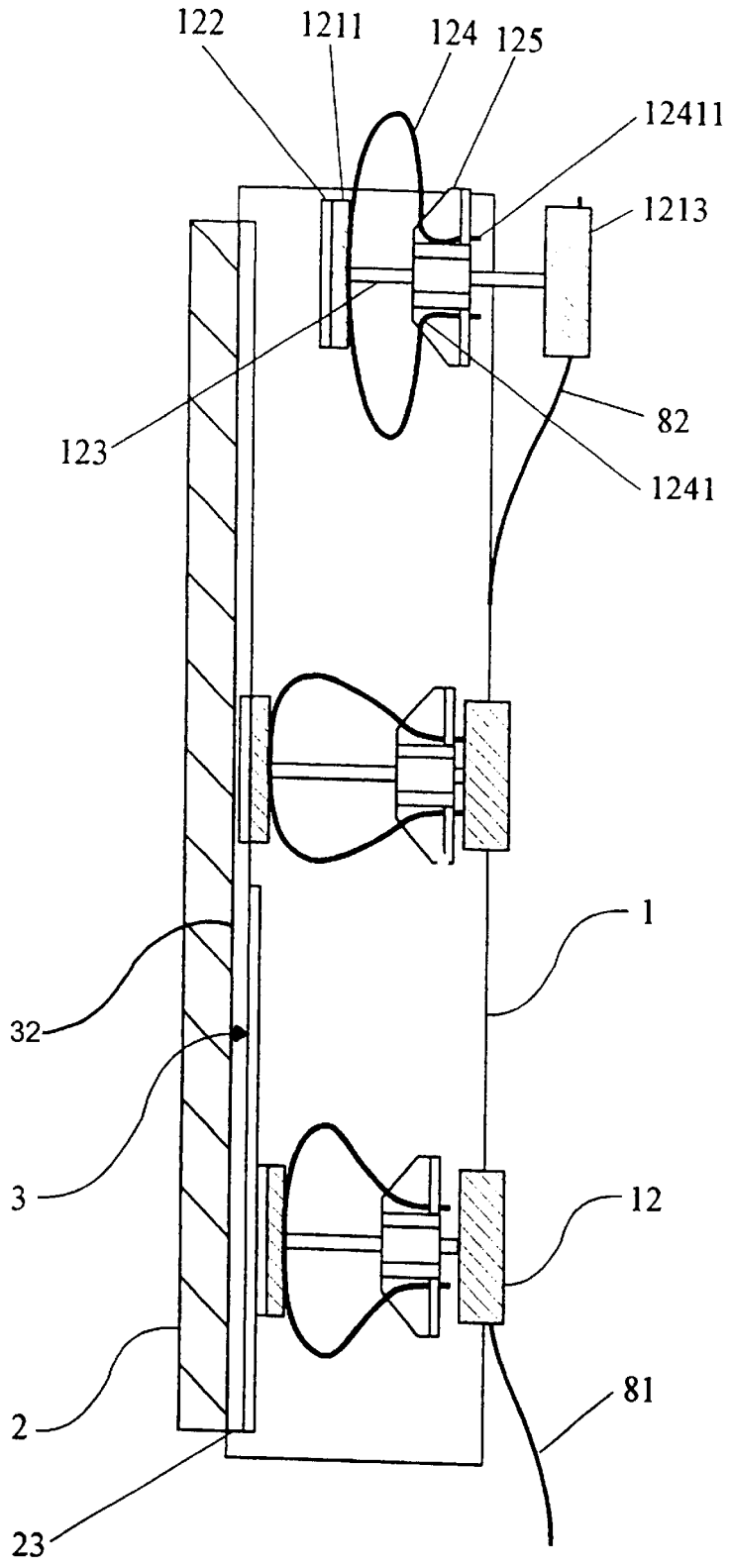
FIG. 11 is a partly sectional, plan view of the device of FIG. 1 with three possible positions for the pressure element.

The pressure elements 12 hold a surface 32 to be printed against a guide plate 2, as is indicated in FIGS. 3 and 11.

In order to pre-position the pieces of mail 3 and minimize the transport forces, the guide plate 2 is inclined at an angle of at least $\alpha$=18° from the vertical.

The guide plate 2 is equipped with parallel sliding rails 23, 231 extending in the direction of transport as seen in FIG. 1, in order to improve sliding characteristics.

In the print area, the guide plate 2 has a first cutout 21 for an ink jet print head 4. The cutout 21 is disposed at the height at which postage indicia is to be printed. A second, higher cutout 22 is provided in case an address is also to be printed on the piece of mail 3.

As desired, a second ink jet print head 4 can be dedicated to this cutout 22 or a common, adjustable ink jet print head 4 can be used to print both the postage indicia and the address. Regardless of which variant is used, a nozzle plane 40 of the ink jet print head 4 shown in FIG. 2*c* must always be parallel to the guide plate 2 and the piece of mail 3 must be as close as possible, within 2 mm, to the nozzle plane while fed passed the latter.

In respective regions 25 downstream of the cutouts 21, 22, the sliding rails 231 are separated by a distance a which is greater than a width b of the printed image. A thickness d of the sliding rails 231 is greater than the greatest expected convexity of the piece of mail 3 in the printed area.

Figure 2A:
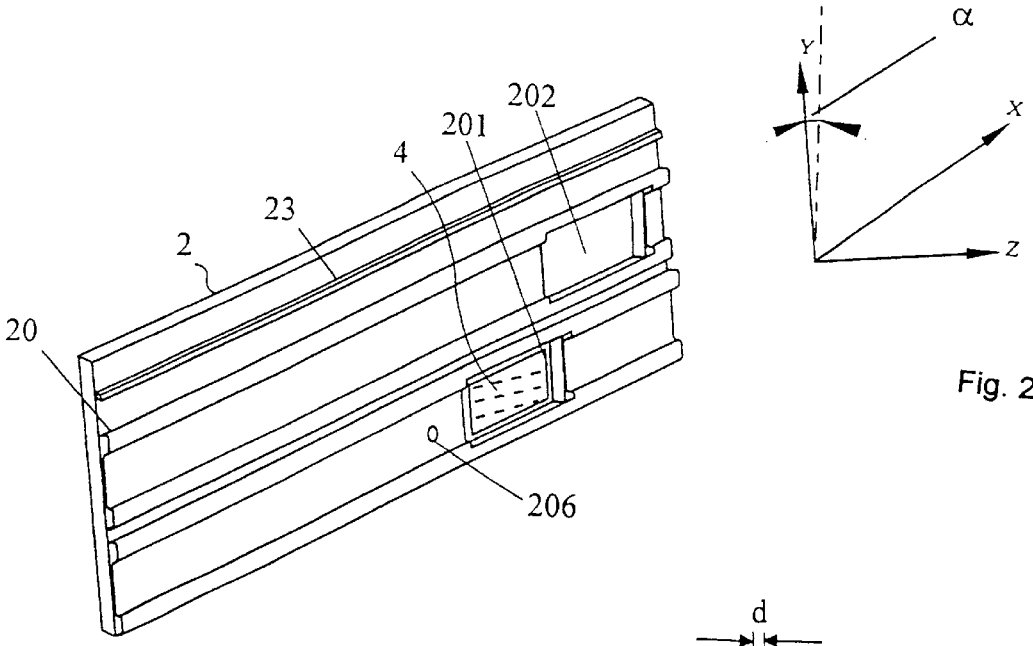

As is shown in FIG. 2*a,* the guide plate 2 is equipped in the primary support and print area for the piece of mail 3 with an insert 20 extending in the direction of transport.

Figure 2B:
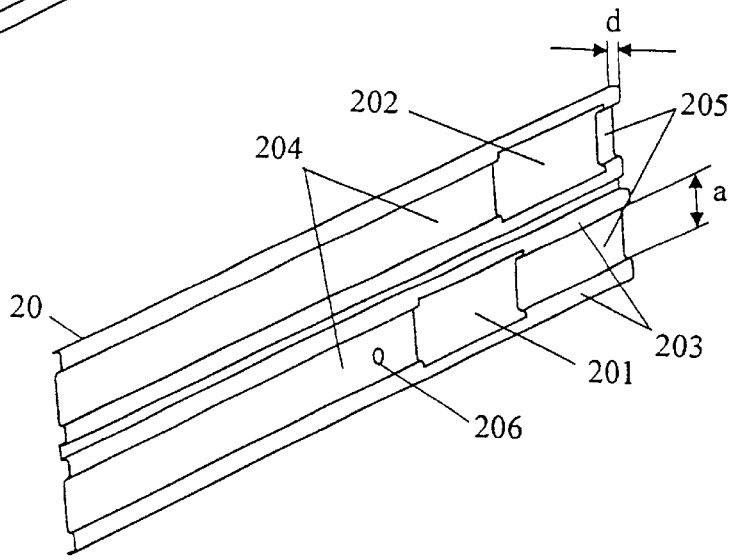
FIG. 2*b* is a perspective view of the insert.

Cutouts 201, 202 for the ink jet print head 4 and an opening 206 for the sensor 7 are punched in the guide plate 2 and all other necessary structures, including sliding rails 203, are stamped into the insert 20, as is seen in FIG. 2*b*.

It is appropriate for the insert 20 to be a piece of stainless steel.

The sliding rails 203 are located above and below the cutouts 201, 202 for the ink jet print head 4 and extend over the entire length of the insert 20.

In a region 205 downstream of the cutouts 201, 202, the sliding rails 203 are separated by the distance a which is greater than the width b of the printed image. The thickness d of the sliding rails 203 is greater than the greatest expected convexity of the piece of mail 3 in the printed area. A distance a >25 mm and a thickness d=2 mm are sufficient.

Figure 2C:
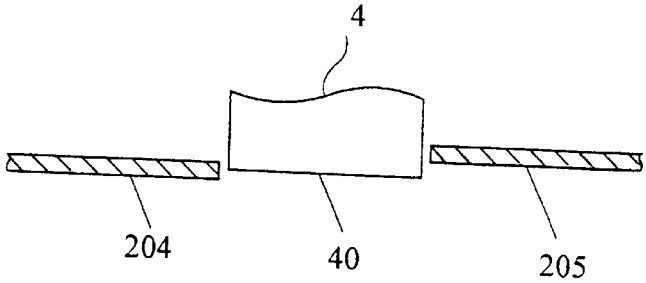
FIG. 2*c* is a fragmentary, longitudinal-sectional view of a print area.

As can be seen in FIG. 2*c,* a region area 204 upstream of the cutouts 201, 202, the nozzle plane 40 of the ink jet print head 4 and a region 205 thereafter are progressively recessed. This prevents the pieces of mail from catching, thus preventing jams and increasing the reliability of transport of the piece of mail.

Production is unproblematic if the insert is manufactured from an appropriate sheet steel.

As is shown in FIG. 3, the guide plate 2 is L-shaped, whereby the piece of mail 3 stands on one edge 31 and stands on or slides along a short leg 27 of the L-shaped portion of the guide plate 2 while resting against a long leg 26 or the sliding rails 23 thereon. The two legs 26 and 27 are, of course, orthogonal to one another. The short leg 27 is highly-polished in the direction of transport. This would also be true for the entire guide plate 2 if there were no sliding rails 23.

Otherwise, this embodiment is configured analogous to that described above.

There are a variety of possible configurations for the pressure elements 12. They can be fastened in roughly the center of the conveyor 1 or at the greatest possible distance from the guide plate 2.

In the embodiment shown in FIG. 4, the pressure elements 12 are strip-shaped clamping elements standing on one longitudinal edge, perpendicular to the direction of travel and fastened to the conveyor at an end 1201 facing away from the guide plate 2.

Unlike FIG. 1, a permanent connection is preferred and can be realized through the use of gluing or bonding.

In a reversing zone at the front of the conveyor, the clamping element 12 is bent opposite the direction of transport by the deflecting element 8 and slides smoothly along the deflecting element 8, moving laterally until coming in contact with the piece of mail 3.

In the embodiment shown in FIG. 5, the strip-shaped clamping elements lie flat on the conveyor 1 and perpendicular to the direction of transport while being connected to the conveyor 1 at the end 1201 facing away from the guide plate 2. The clamping element slides along the deflecting element 8, moving downward until coming in contact with the piece of mail 3.

In the embodiment shown in FIG. 6, the clamping element 12 is realized as a ring-shaped clamping element standing on edge and being fastened to the conveyor 1 at the part 1201 farthest away from the guide plate 2.

Figure 7:
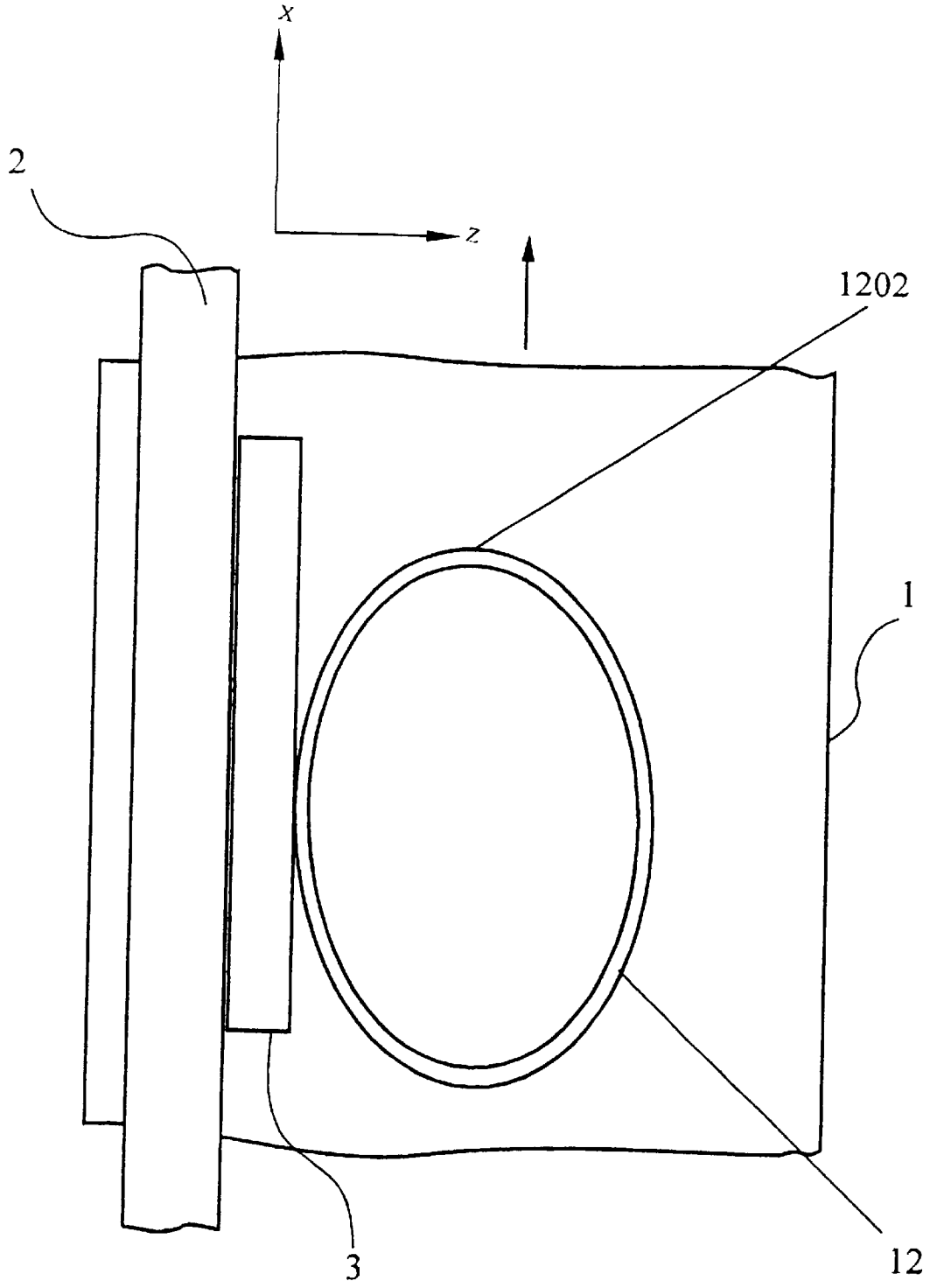
FIG. 7 is a plan view of a conveyor with ring-shaped clamping elements, center mounted on edge.

FIG. 7 shows an embodiment in which the ring-shaped clamping element 12 is connected to the conveyor 1 in the center of a frontmost section 1202 of the element relative to the direction of transport indicated by an arrow.

Figure 8:
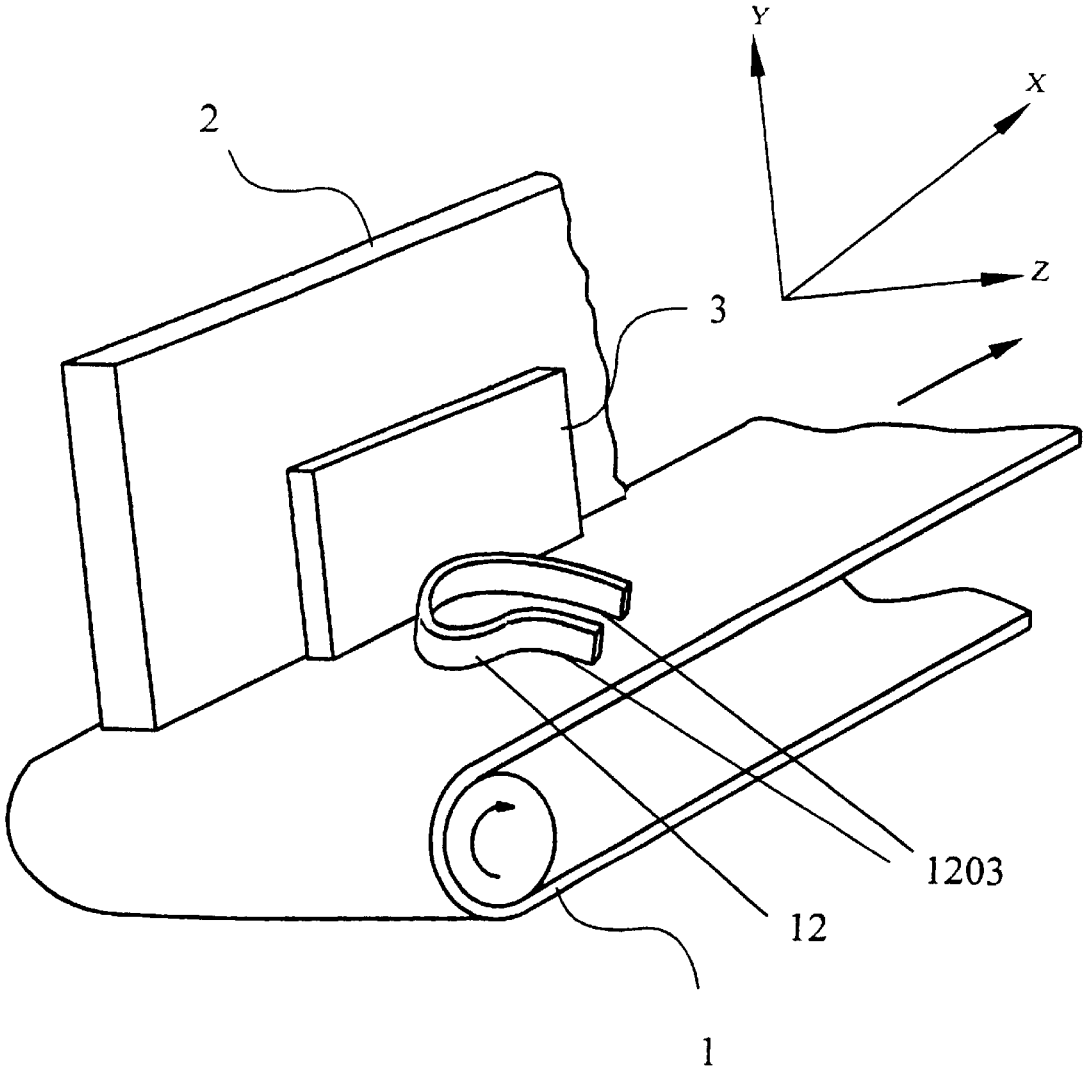
FIG. 8 is a further view similar to FIG. 4 of a conveyor with U-shaped clamping elements.

In an analogous embodiment shown in FIG. 8, the pressure elements 12 are realized as U-shaped clamping elements. The U-shaped clamping elements 12 stand on edge, are perpendicular to the direction of transport and are connected to the conveyor 1 at legs 1203, which face away from the guide plate 2. The semi-circular region of the clamping element 12 stands on edge on the conveyor 1 and deflects opposite to the direction of transport.

All of the clamping elements 12 described above are made of an elastic material, preferably a polyurethane material.

In the embodiment shown in FIGS. 9 and 10, the pressure element 12 is realized as a spring-mounted bracket 121, having an axle 123 which is mounted perpendicular to the direction of transport in a friction bearing 1251. The friction bearing 1251 is rigidly connected to a bearing bracket 125, which is in turn fastened to the conveyor 1.

Mounted on one end of the axle 123 is a pressure plate 1211 having a friction lining 122 facing the guide plate 2, so that the pressure plate 1211 can form a force-locking connection to only one piece of mail 3. A force-locking connection is one which connects two elements together by force external to the elements, as opposed to a form-locking connection which is provided by the shapes of the elements themselves.

If no piece of mail 3 is present, the pressure plate 1211 slides along the sliding rail 23 or 203, i.e. the friction lining 122 is thinner than the thickness d of the sliding rail 23, 203 or the amount by which it protrudes, and is thus free, as is seen in FIG. 11.

A cover or top plate 1212, which rests against a rear wall 1252 of the bearing bracket 125 and is terminated by a rear all 1213, is connected to the rear of the pressure plate 1211 to prevent the pressure plate from tipping.

The pressure plate 1211 has a bore 12111 and the rear wall 1213 has a bore 12131. Both bores 12111, 12131 are used to seat the axle 123.

A U-shaped spring 124 is located between the pressure plate 1211 and the bearing bracket 125 in such a manner that a curved portion thereof rests against the pressure plate 1211 and free legs 1241 are held in the bearing bracket 125.

A center section 1240 of the spring 124 has a bore 12401 through which the spring 124 is slid onto the axle 123, where it is snugly seated.

The free legs 1241 of the spring 124 are form-lockingly connected in slot-shaped cutouts 12521 in the rear wall 1252 of the bearing bracket 125. Ends 12411 of the legs 1241 protrude somewhat beyond the rear wall 1252, thus serving as a buffered stop for the rear wall 1213 of the bracket 121.

The spring 124 is preferably made of rubber to achieve good service life, elasticity and damping characteristics. Last but not least, this material is economical.

The rear wall 1213 of the bracket 121 includes an extension 12132 which can engage the deflection elements 8. At the front of the conveyor 1, the extension 12132 engages a part 81 of the connecting link 8 curving toward the guide plate 2. At the rear of the conveyor, the extension 12132 engages a part 82 of the connecting link 8 curving away from the guide plate 2, as is seen in FIGS. 1 and 11.

FIG. 11 shows three characteristic positions which the pressure element 12 can assume. For the sake of clarity, the section below the top plate 1212 of the bracket 121 is shown. In the lower position, the pressure element 12 has just been released by the part 81 of the connecting link 8 curving towards the guide plate 2. The piece of mail 3 is clamped between the friction lining 122 and the sliding rails 23.

In the center position, there is no piece of mail present. The pressure plate 1211 rests against the sliding rail 23 and the friction lining 122 is at some distance from the guide plate 2 and is thus exposed. The rear wall 1213 of the bracket 121 rests against the ends 12411 of the U-shaped spring 124.

In the upper position, the pressure element 12 is pulled away from the guide plate 2 by the part 82 of the connecting link curving away from the guide plate 2. The spring 124 is compressed and the rear wall 1213 rests with the extension 2132 seen in FIG. 10 against the deflecting element 82.

Figure 12:
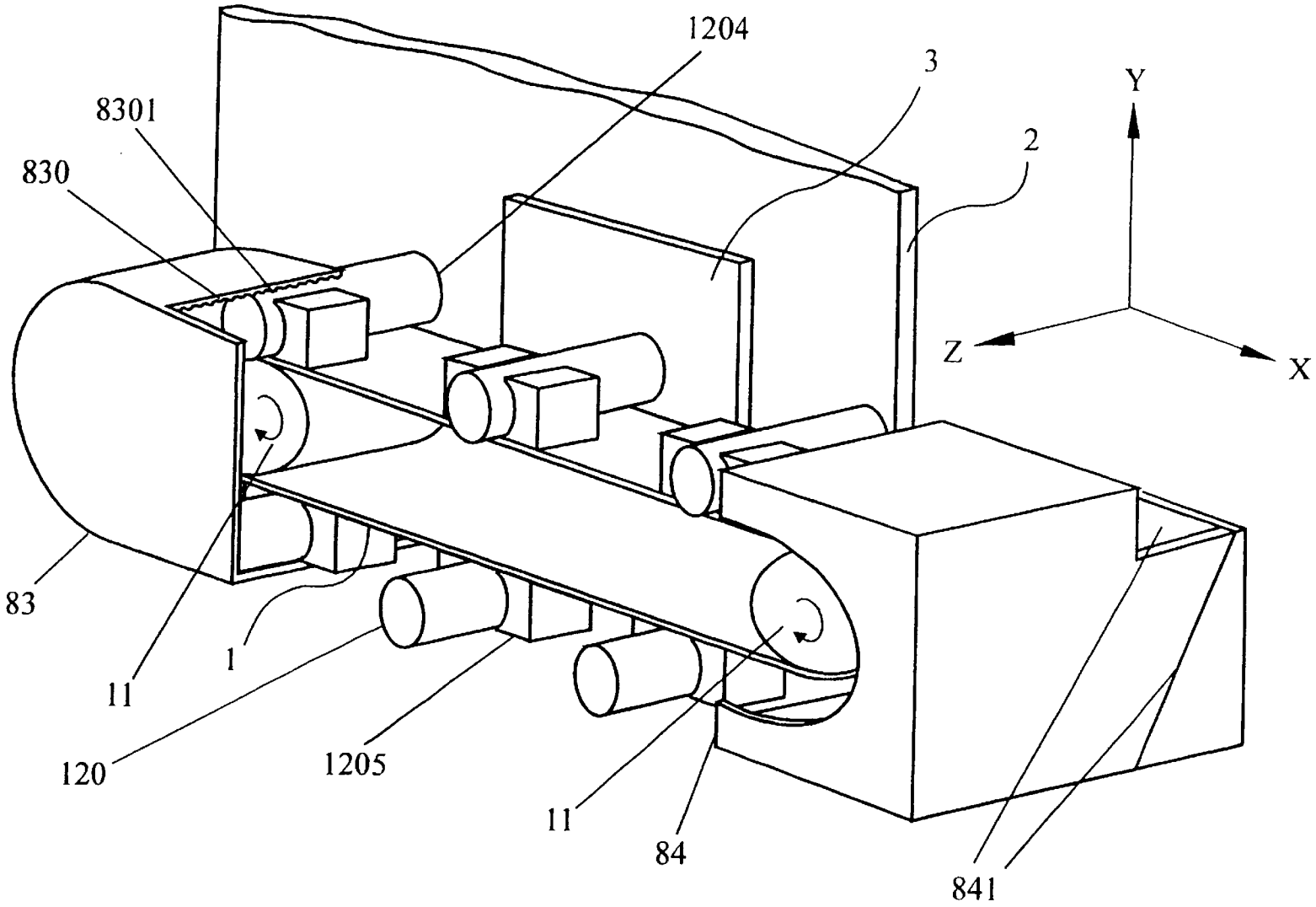
FIG. 12 is a fragmentary, perspective view of a conveyor with solid cylinders and clamping jaws.

In FIG. 12, the pressure elements 12 are realized as elastic, solid cylinders 120 that are held perpendicular to the direction of transport between clamping jaws 1205. The clamping jaws 1205 are fastened to and extend across the width of the conveyor 1. The piece of mail 3 is clamped between an end surface 1204 of the solid cylinder 120 and the guide plate 2. The clamping jaws 1205 are spread apart where the conveyor 1 reverses due to the curvature of the conveyor 1, so that the solid cylinders 120 lie loosely between the clamping jaws 1205 and can be easily displaced.

Figure 13:
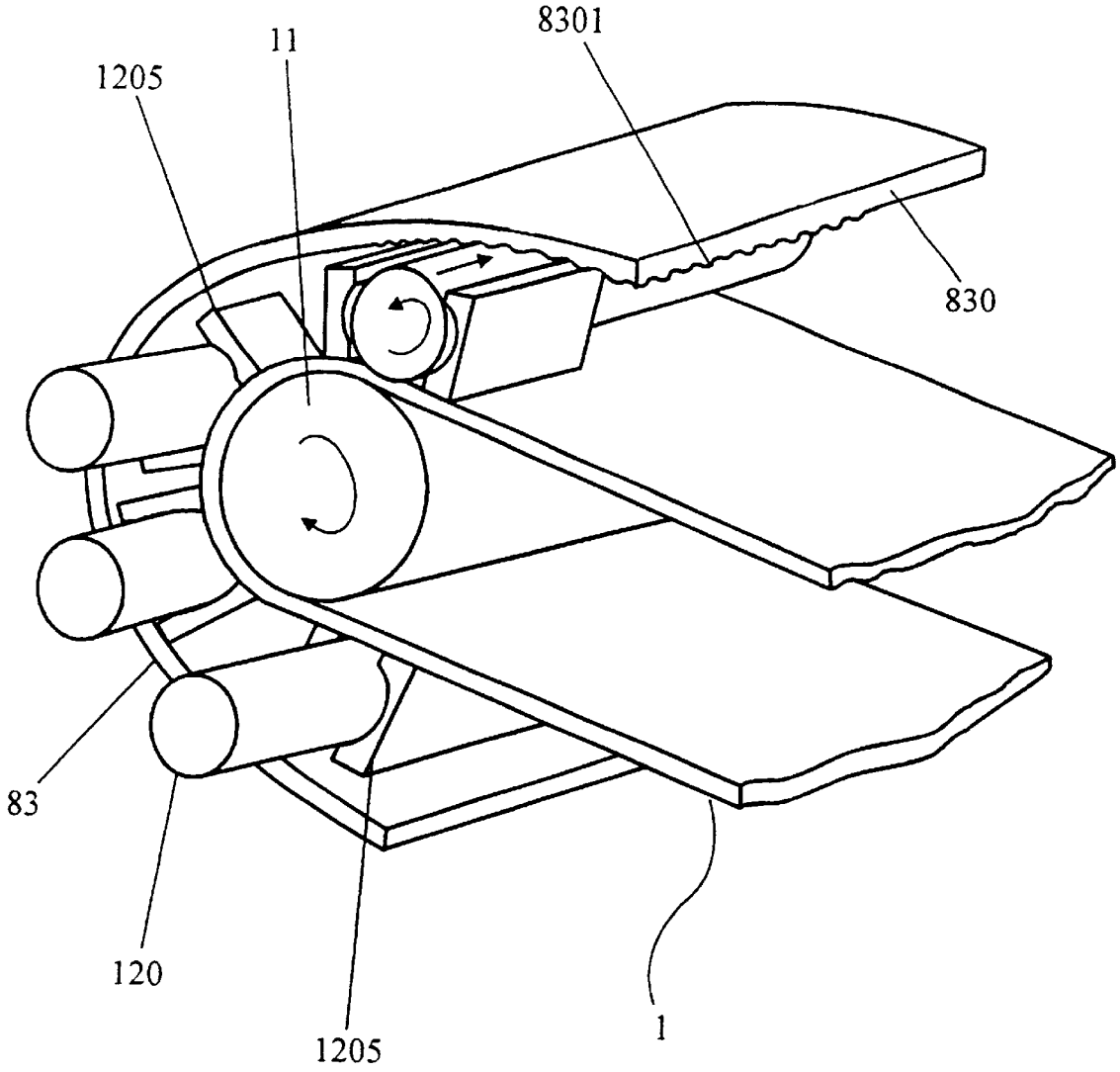
FIG. 13 is a fragmentary, perspective view showing details of a deflection as is shown in FIG. 12 in a reversal zone at the front of the conveyor.

As is shown in FIG. 13, the reversing zone at the front of the conveyor 1 is enclosed in a cage 83 which prevents the solid cylinders 120 from falling out of the clamping jaws 1205 while also serving as the deflecting element 8.

To this end, the cage 83 encloses the conveyor 1 so closely from the turning point on that the solid cylinders 120 are held by friction between the conveyor 1 and an inner top wall 830 of the cage 83. Furthermore, a portion of the inner top wall 830 has a tooth profile 8301 inclined in the direction of the guide plate 2 and running diagonally to the direction of transport. Due to the force-locking connection between the solid cylinder 120 and the inner top wall 830 or the tooth profile 8301, an elastic counter-profile is impressed into a jacket surface 1206 of the solid cylinder 120, and the latter is rotated so as to move perpendicular to the direction of transport and toward the guide plate 2. The force-locking connection and tooth profile 8301 are provided in such a way that the solid cylinder 120 only moves so far outward that there is a slight distance between the end surface 1204 of the solid cylinder 120 and the guide plate 2 and a thin piece of mail 3 can be lightly held. With thick pieces of mail 3, the cylinders slide back in adjustment.

Figure 14:
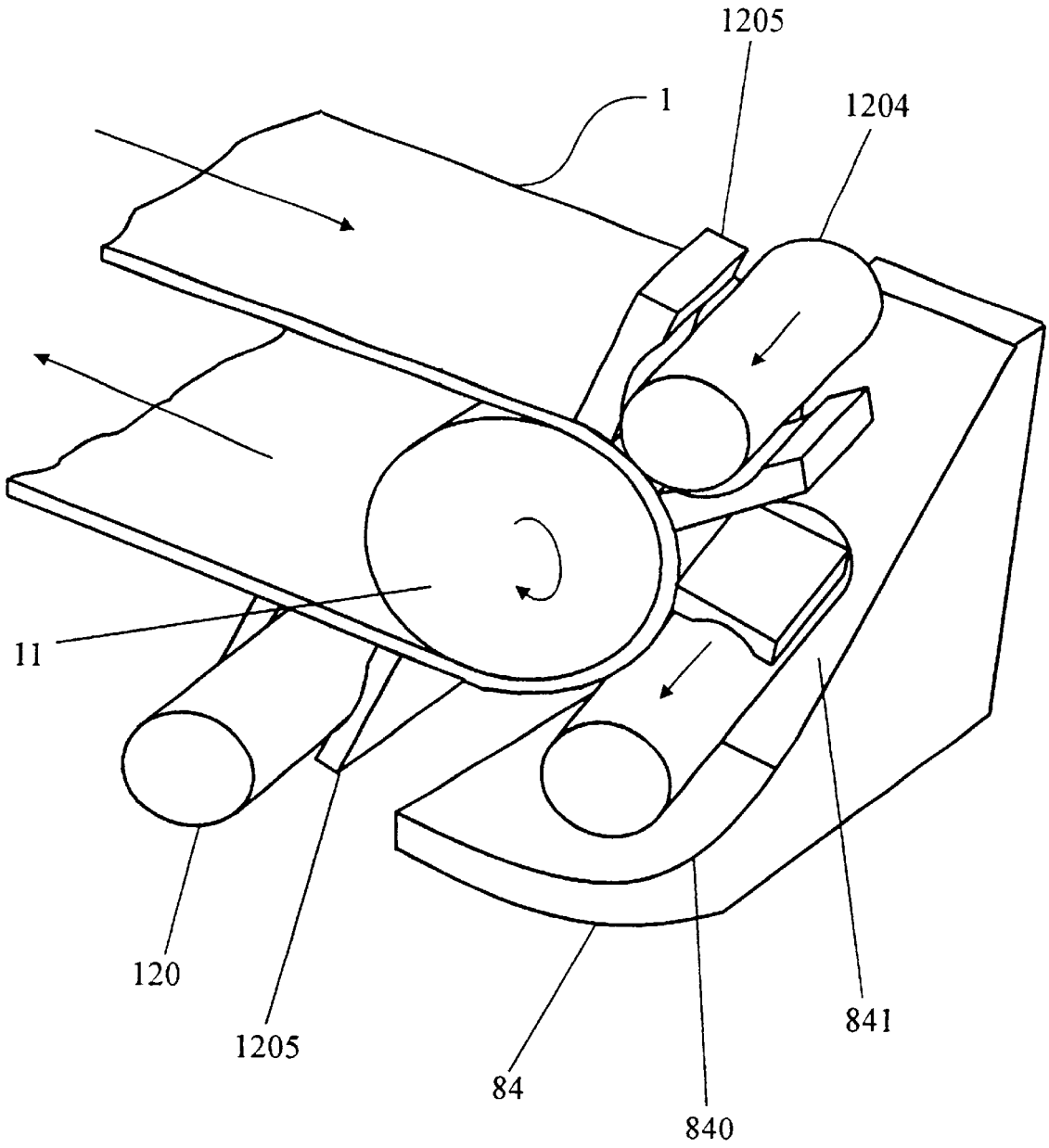
FIG. 14 is a fragmentary, perspective view showing details of the deflection as is shown in FIG. 12 in a reversal zone at the rear of the conveyor.

FIG. 14 represents the prevailing conditions at the rear reversing zone of the conveyor 1. In this case, a cage 84 encloses the conveyor 1 and the cage likewise prevents the solid cylinders 120 from falling out of the clamping jaws 1205 while also serving as a deflecting element. To this end, an inner side wall 841 adjacent the guide plate 2 is angled outward.

The loose solid cylinders 120 slide with their end surface 1204 along the inner side wall 841 and are thus pushed so far outward that the thickest permissible piece of mail 3 easily fits between the end surface 1204 and the guide plate 2, and is thus released.

An inner top wall 840 of the cage 84 is at such a distance from the conveyor 1 as to ensure that the solid cylinders 120 are loosely held. The cage 84 encloses a sufficient length of the conveyor 1 to ensure that the solid cylinders 120 are again clamped between the clamping jaws 1205 as they leave the reversing zone.

We claim:

1. A device for printing to non-vertical stock, comprising:

a non-vertically aligned guide plate having one side along which stock slides in a non-vertical orientation in a transport direction during transport and printing, a downstream end, a recessed region having at least one cutout, and a region following said at least one cutoff toward said downstream end at which the stock is substantially free of contact with said guide plate;

an advancing device for advancing the stock along said guide plate in the transport direction; and an ink jet print head of an ink jet printing device for printing to the stock disposed in said recessed region, said ink jet print head having a nozzle plane oriented substantially parallel to said guide plate.

2. The device according to claim 1, wherein said one side of said guide plate is a bearing surface for the stock, and said region of said guide plate downstream of said at least one cutout is recessed relative to said bearing surface.

3. The device according to claim 1, wherein said at least one cutout of said recessed region has an open downstream end.

4. The device according to claim 1, wherein said guide plate is planar plate against which one surface of the stock rests, and said planar plate has sliding rails extending in the transport direction.

5. The device according to claim 4, wherein said at least one ink jet print head prints an image with a given width, and said sliding rails in said region downstream of said at least one cutoff are separated by a distance greater than said given width and have a thickness greater than an expected convexity of the stock in a printed area.

6. The device according to claim 1, wherein said guide plate has a stainless steel insert with at least one cutout, integral sliding rails, a region upstream of said at least one cutout and a region downstream of said at least one cutout, and said region upstream of said at least one cutout, said nozzle plane and said downstream region are progressively recessed.

7. The device according to claim 1, wherein said at least one cutout is one of a plurality of cutouts, and said ink jet print head is one of a plurality of ink jet print heads each operatively associated with a respective one of said cutouts.

8. The device according to claim 1, wherein said at least one cutout is one of two cutouts, and said at least one ink jet print head is a single, height-adjustable ink jet print head for both of said cutouts.

9. The device according to claim 1, wherein the stock is a piece of mail and the device is part of a postage meter.

10. The device according to claim 1, wherein the stock is a piece of mail and the device is part of an addressing machine.

11. A device for printing stock, comprising:

a non-vertical guide plate formed with one side along which stock slides in a non-vertical orientation along a transport direction during transport and printing, a downstream end, a recessed region having at least one cutout, and a region following said at least one cutout toward said downstream end whereat the stock is free of contact with said guide plate;

a conveyor for advancing the stock along said guide plate in the transport direction; and an ink jet print head of an ink jet printing device for printing to the stock disposed in said recessed region, said ink jet print head having a nozzle plane oriented substantially parallel to said guide plate.

12. The device according to claim 11, wherein said one side of said guide plate is a bearing surface for the stock, and said region of said guide plate downstream of said at least one cutout is recessed relative to said bearing surface.

13. The device according to claim 11, wherein at least one cutout of said recessed region has an open downstream end.

14. The device according to claim 11, wherein said guide plate is a planar plate against which one surface of the stock rests, and said planar plate has sliding rails extending in the transport direction.

15. The device according to claim 14, wherein said ink jet print head prints an image with a given width, and said sliding rails in said region downstream of said at least one cutout are separated by a distance greater than said given width and have a thickness greater than an expected convexity of the stock in a printed area.

16. The device according to claim 11, wherein said guide plate has a stainless steel insert with at least one cutout, integral sliding rails, a region upstream of said at least one cutout and a region downstream of said at least one cutout, and said region upstream of said at least one cutout, said nozzle plane and said downstream region are progressively recessed.

17. The device according to claim 11, wherein said at least one cutout is one of a plurality of cutouts, and said ink jet print head is one of a plurality of ink jet print heads each operatively associated with a respective one of said cutouts.

18. The device according to claim 11, wherein said at least one cutout is one of two cutouts, and said at least one ink jet print head is a single, height-adjustable ink jet print head for both of said cutouts.

19. The device according to claim 11, wherein the stock is a piece of mail and the device is part of a postage meter.

20. The device according to claim 11, wherein the stock is a piece of mail and the device is part of an addressing machine.

* * * * *